US006017995A

United States Patent [19]

Beuschel et al.

[11] Patent Number: 6,017,995

[45] Date of Patent: Jan. 25, 2000

[54] SUSPENSION FOR THE SOLVENT-FREE PRODUCTION OF SILICONE RESIN-BONDED PAPERS BASED ON SHEET SILICATES

[75] Inventors: Guenter Beuschel; Holger Rautschek, both of Nuenchritz, Germany

[73] Assignee: Wacker-Chemie GmbH, Munich, Germany

[21] Appl. No.: 09/073,910

[22] Filed: May 7, 1998

[30] Foreign Application Priority Data

May 7, 1997 [DE] Germany ..... 197 19 302

[51] Int. Cl.[7] ..... C08L 83/00

[52] U.S. Cl. ..... 524/588; 524/837

[58] Field of Search ..... 524/588, 837

[56] References Cited

U.S. PATENT DOCUMENTS 5,708,113 1/1998 Beuschel et al. .

FOREIGN PATENT DOCUMENTS 44 26 212 A1 1/1996 Germany .

*Primary Examiner*—Melvyn I. Marquis
*Assistant Examiner*—Mark W. Milstead
*Attorney, Agent, or Firm*—Oblon, Spivak, McClelland, Maier & Neustadt, P.C.

[57] ABSTRACT

A suspension for the solvent-free production of silicone resin-bonded papers based on sheet silicates, which consists of:

(a) 100 parts by weight of a sheet silicate, (b) 100 to 10,000 parts by weight of water, (c) 0.1 to 5 parts by weight of at least one silane of formula (I):

$$(R'O)_aSiR_{4-a} \quad (I)$$

in which R denotes substituted or unsubstituted hydrocarbon radicals having 1 to 20 carbon atoms and R' denotes $C_{1-10}$-alkyl, aryl, alkylaryl or hydrogen and a assumes a value from 1 to 3, and/or the partial hydrolysis product thereof, (d) 1 to 50 parts by weight of a pulverulent silicone resin of formula (II):

$$(R'O)_bSiR_cO_{(4-b-c)/2} \quad (II)$$

in which R and $R^1$ have the abovementioned meaning and b assumes a value from 0 to 0.5 and c a value from 0.7 to 1.3, with the proviso that at least 5 parts by weight of the silicone resin of formula (II) are used per part by weight of the compound of formula (I), (e) 0.01 to 20 parts by weight of a compound catalyzing the hydrolysis and/or condensation of the compounds of formulae (I) and/or (II) and (f) optionally further known additives.

15 Claims, No Drawings

SUSPENSION FOR THE SOLVENT-FREE PRODUCTION OF SILICONE RESIN-BONDED PAPERS BASED ON SHEET SILICATES

BACKGROUND OF THE INVENTION

1. Field of the Invention

The present invention relates to suspensions for the solvent-free production of silicone resin-bonded papers based on sheet silicates.

2. Description of the Background

Silicone resin-bonded papers based on sheet silicates are important intermediates for the production of moldings which are used, for example, as insulators in the electrical industry, particularly where considerable heating occurs during the use of the electrical apparatus, for example in toasters, electric heaters, soldering apparatuses and hairdryers.

Solvent methods or suspension methods are known for the production of these silicone resin-bonded papers (A. Tomanek: Silicone & Technik, page 145; C. Hanser Verlag Munich 1990).

In the solvent method, a paper produced separately, for example, as described in DD 292 944, and comprising sheet silicates of the likes of mica, is impregnated with a solution of silicone resin and then dried. This silicone resin-bonded paper produced in this manner can then be processed as a prepreg in the desired manner. The particular disadvantage of this two-stage process is that, in the second stage, the paper is impregnated with a solution of a silicone resin in an organic, generally aromatic solvent and therefore the solvent vapors formed during the subsequent drying have to be handled by a technically complicated procedure. BE 758 263 describes the hydrophobization of the mica by means of silanes or silanols to increase the resistance of the mica to the solvents used. However, since these papers have insufficient mechanical strength for subsequent applications, they must then be further strengthened with solutions of resins, for example epoxy resins, in organic solvents.

One-stage processes which permit paper formation and binding of the paper in one step are likewise known (DE 11 26 467). In this process, paper formation is effected in the presence of a silicone resin solution. However, solvent-containing air is likewise formed during the drying of the papers, and in addition the wastewater is contaminated with solvent.

These ecological problems are substantially solved by the suspension method. This method is described, inter alia, in DE 44 26 213. Here, a pulp of solid silicone resin powder, sheet silicates (generally lamellar mica), water and optionally further additives is produced. This pulp is processed by suitable known methods to give papers which, after drying, can be used as prepregs for the production of mechanically stable sheets of resin-bonded sheet silicate material, so-called micanite sheets. The disadvantage of this process is that the electrical and mechanical characteristics (for example, the tensile strength, the flexural strength and the water absorption) of the micanite sheets thus produced or of the moldings or insulation materials produced therefrom are poorer than in the case of those micanite sheets which are produced from silicone resin-bonded papers manufactured by the solvent method. A further deficiency of the papers produced by known suspension methods is that a great deal of dust is generated during the processing of sheets to moldings, for example by punching, sawing and cutting. A need therefore continues to exist for silicone resin-bonded papers of improved mechanical and electrical properties.

SUMMARY OF THE INVENTION

Accordingly, one object of the present invention is to provide silicone resin-bonded papers which are based on sheet silicates and can be processed as prepregs to give micanite sheets having improved mechanical and electrical properties, with no organic solvents having been used in the production of the sheets with minimal generation of dust during processing.

Another object of the invention is to provide a solvent free suspension for the production of silicone resin-bonded papers.

Briefly, these objects and other objects of the present invention as hereinafter will become more readily apparent can be attained by a suspension for the solvent-free production of silicone resin-bonded papers based on sheet silicates, which consists of (a) 100 parts by weight of a sheet silicate, (b) 100 to 10,000 parts by weight of water, (c) 0.1 to 5 parts by weight of at least one silane of the formula:

$$(R'O)_aSiR_{4-a} \quad (I)$$

wherein R is substituted or unsubstituted hydrocarbon radicals having 1 to 20 carbon atoms and R' is $C_{1-10}$-alkyl, aryl, alkylaryl or hydrogen and is a value of 1 to 3, and/or the partial hydrolysis product thereof, (d) 1 to 50 parts by weight of a pulverulent silicone resin of the formula:

$$(R'O)_bSiR_cO_{(4-b-c)/2} \quad (II)$$

wherein R and R' are as defined above and b is a value of 0 to 0.5 and c is a value of 0.7 to 1.3, with the proviso that at least 5 parts by weight of the silicone resin (II) are used per part by weight of the compound (I), (e) 0.01 to 20 parts by weight of a compound catalyzing the hydrolysis and/or condensation of the compounds of formulae (I) and/or (II) and (f) optionally further known additives.

DETAILED DESCRIPTION OF THE PREFERRED EMBODIMENTS

A paper is produced from the suspension of the invention by known methods and is dried. Surprisingly, as a result of the production of the suspension virtually in one stage and because of the small amounts of silane added during the mixing of the mica with the water, the papers produced therefrom give, after processing to micanite sheets, materials which are superior even to those produced by the ecologically disadvantageous solvent method.

Sheet silicates of natural and/or synthetic micas are preferably employed. Suitable examples of natural micas include pale (potassium- and aluminum-rich) micas such as muscovite, and dark (iron-rich) micas such as biotite. However, mica-like minerals, for example micas produced from marine clays such as illite, and synthesized micas may also be used in the process of the invention. The micas may be prepared both by a thermal method (expansion with carbonates) and by wet milling. The sheet silicate particles preferably have a thickness of less than 0.5 mm and an average diameter of 0.1 to 10 mm. The wet milling of the mica can be carried out during the preparation of the suspension of the invention, in the presence of the compound of the formula (I), which constitutes a further simplification of the process by simultaneously carrying out a plurality of steps conventionally effected separately.

R may be any known hydrocarbon radical having up to 10 carbon atoms, and these radicals include n-alkyl radicals such as ethyl, hexyl and cyclohexyl; isoalkyl radicals such as isopropyl and isoamyl radicals; alkyl radicals having tertiary carbon atoms such as tert-butyl and tert-pentyl; aromatic hydrocarbon radicals having more than 6 carbon atoms such as phenyl, naphthyl and anthryl radicals; alkylaryl radicals in which the silicon is bonded either to an aromatic carbon such as in tolyl radicals, or to an aliphatic carbon such as in benzyl radicals; radicals having olefin double bonds such as vinyl, allyl and norbornyl radicals, and substituted hydrocarbon radicals such as trifluoropropyl, cyanoethyl, aminopropyl, alkoxyaryl, alkoxyalkyl and haloaryl radicals. Preferred radicals R' in the formula (I) include methyl, ethyl, propyl and butyl radicals. R' may also denote hydrogen, and such compounds are formed, for example, as intermediates in the hydrolysis of alkoxysilanes and can be stabilized, i.e. the generally very rapid silanol condensation can be at least partially inhibited.

Suitable examples of compounds of the formula (I) include methyltrimethoxysilane, methyltriethoxysilane, ethyltrimethoxysilane, ethyltriethoxysilane, propyltrimethoxysilane, or isobutyltriethoxysilane, octyltrimethoxysilane, octyltriethoxysilane, dimethyldiethoxysilane, dimethyldimethoxysilane, trimethylmethoxysilane, triphenylmethoxysilane, triphenylethoxysilane, N-aminoethyl-3-aminopropyltrimethoxysilane, 3-aminopropyltrimethoxysilane, 3-aminopropyltriethoxysilane, N-aminoethyl-3-aminopropylmethyldimethoxysilane, 3-glycidyloxypropylmethyldiethoxysilane, 3-glycidyloxypropyltrimethoxysilane, methacryloyloxypropyltrimethoxysilane 3-ureidopropyltriethoxysilane, 3-mercaptopropylmethyldimethoxysilane, cyanopropyltrimethoxysilane, and the like.

The silicone resin of the formula (II) has, as preferred radicals R, methyl, ethyl and phenyl radicals. Methyl, ethyl, propyl and butyl radicals are preferred as radicals R' in the formula (II). The proportion of hydrolyzable groups (OR') in the silicone resin, R' denoting hydrogen or alkyl, is usually 0.1 to 15% by weight. Such products of formula (II) are known and are prepared by known processes, for example by hydrolysis and condensation of alkyltrialkoxysilanes, alkyltrihalosilanes, dialkyldialkoxysilanes and/or dialkyldihalosilanes. The molar proportion of monoalkylsilanes in the synthesis of the silicone resins is preferably above 80 mol %. The weight average molecular weight of the silicone resins is preferably in the range from 2000 to 50,000 g/mol (GPC, based on polystyrene). Particularly important for the suitability in the process of the invention is the glass transition temperature of the silicone resin used, which is preferably above the processing temperature. Silicone resins having a glass transition temperature greater than 40° C. are particularly preferred.

Preferred compounds catalyzing the hydrolysis and/or the condensation of the compounds of formula (I) and/or (II) are organometallic compounds, usually compounds of the formula $$R^1_g MR^2_{(w-g)-(z+h)} L_h \quad \text{(III)}$$

wherein $R^1$ represents identical or different, substituted and/or unsubstituted carboxyl radicals having 1 to 30 carbon atoms and/or identical or different, substituted and/or unsubstituted alkoxy radicals having 1 to 4 carbon atoms and $R^2$ represents identical or different, substituted and/or unsubstituted hydrocarbon radicals having 1 to 10 carbon atoms, M is a metal of the 2nd, 3rd or 4th main group or 2nd to 8th subgroup of the Periodic Table, L represents identical or different chelate ligands having z bonds to the metal M, w is the coordination number of M, g assumes a value between 1 and w and h assumes values between 0 and 3, and/or the partial hydrolysis products thereof. A preferred metal M is tin, zinc, aluminum, zirconium, iron, titanium or hafnium. Examples of such compounds are aluminum soaps, carboxylic acids having 4 to 18 carbon atoms such as aluminum hexanoate, aluminum heptanoate, aluminum octanoate, aluminum methylhexanoate, aluminum stearate, aluminum oleate, aluminum ricinolate, mixtures of these aluminum soaps, mixed aluminum soaps and aluminum soaps which still contain radicals of oxygen bonded to aluminum, for example as a hydroxyl group, polymeric organotitanium esters or chelates, polymeric organozirconium esters or chelates, polymeric organohafnium esters or chelates (obtainable by partial hydrolysis of, for example, tetramethyl titanate, tetraethyl titanate, tetrapropyl titanate, tetraisopropyl titanate, tetrabutyl titanate, tetraisobutyl titanate, cresyl titanate, octyleneglycol titanate, diisobutyl bisacetylacetatotitanate, triethanolamine titanate, diisopropyl bisacetylacetatotitanate), titanium chelates, citric acid as the chelate ligand, the analogous zirconium or hafnium compounds or mixtures of these compounds, metal acetylacetonates such as aluminum acetylacetonate, iron acetylacetonate, zinc acetylacetonate, calcium acetylacetonate, nickel acetylacetonate, titanium acetylacetonate, zirconium acetylacetonate and hafnium acetylacetonate.

A combination or a modification of the organometallic compound with silanes which contain polar groups gives particularly advantageous catalysts for the production of silicone resin-bonded papers based on sheet silicates. Thus, for example, organometallic compounds of formula (III) can be silanized, in the presence of water, with an organosilicon compound of the formula:

$$R^3_a SiX_{(4-a)} \quad \text{(IV)}$$

wherein $R^3$ represents identical or different, substituted and/or unsubstituted hydrocarbon radicals having 1 to 10 carbon atoms, with the proviso that at least one radical $R^3$ per compound (III) contains a polar group, X is a hydrolyzable radical selected from alkoxy, alkenyloxy, acetoxy, amino, amido, aminoxy, oximino and/or halogen groups and a is an integer ranging from 1 to 3, and/or the partial hydrolysis products thereof. At least one radical $R^3$ should represent a group having a basic nitrogen, for example, an $R^4_2N[YN(R^4)]_nY$ group, in which $R^4$ represents identical or different, substituted and/or unsubstituted radicals having 1 to 10 carbon atoms or hydrogen, Y represents identical or different, substituted and/or unsubstituted, divalent hydrocarbon radicals having 2 to 6 carbon atoms and n assumes a value ranging from 1 to 4.

The catalytically active compound is preferably added in an amount from 0.01 to 20% by weight, based on the amount of sheet silicate, 0.1 to 2% by weight being particularly preferred.

Further known additives which can be mixed with the suspension include wetting agents, thickeners or fillers such as, for example, finely divided silica, bentone, polyacrylates, cellulose ethers, natural hydrocolloids, and the like.

Wetting agents include surface-active compounds, for example, anionic, cationic and nonionic surfactants. Water-soluble nonionic surfactants preferably include, for example, ethoxylated isotridecyl alcohols, ethoxylated fatty alcohols and ethoxylated natural fats. Surfactants having ethylene oxide and propylene oxide units may also be used. The use of polyether-polysiloxanes is particularly preferred.

The preparation of the suspension of the invention can be conducted in any desired manner. It is advantageous first to mix sheet silicate, water and organosilicon compound of formula (I) for at last one minute and then to admix silicone resin. The sheet silicate may be present in the wet-milled state or in the form of pieces. The catalyzing compound is advantageously mixed together with sheet silicate, water and organosilicon compound of formula (I). However, it is also possible to admix the catalyst together with the silicone resin. Together with the sheet silicate and water and/or the compound of formula (I) and/or the silicone resin, known additives, for example, as those described above can be added to the process step. Wetting agents are preferably admixed with the silicone resin.

The mixing time is not critical, but intimate contact between the compounds used and the particles of the sheet silicate must be possible. The mixing time is therefore preferably one minute to three hours at temperatures ranging from 20 to 25° C., higher temperatures being possible. As a rule, mixing for a longer time has no advantage. During mixing, the sheet silicate may be comminuted, for example by the action of shear forces. If the catalyst is added together with sheet silicate, water and organosilicon compound, the amount thereof may be sufficient for the total suspension. However, it is also possible to add the catalyst in two portions with the silane and with the silicone resin. After the addition of all components, the suspension is mixed again until it is homogeneous, preferably over a time of 1 minute to 3 hours. A mixing time of from 3 to 20 min generally being sufficient.

A paper is produced by known methods from the so-called pulp obtained. Usually, the pulp is placed on a wire, the water is removed by suction and the pulp is dried in the course of about 5 to 30 min at temperatures of 105 to 150° C. By using reduced pressure, the drying temperature can be lowered and/or the drying accelerated. The residual moisture content of the papers is less than 2% by weight, preferably less than 0.5% by weight.

The silicone resin-bonded papers based on sheet silicates which are produced from the suspension of the invention have a thickness of 0.01 to 5 mm, preferably of 0.04 to 1.5 mm, and can be used by known methods as prepregs for the production of micanite sheets, in particular for use as electrical insulating materials. The processing for this purpose is carried out, for example, by molding the prepregs at temperatures of 150 to 300° C. and at a pressure of 0.2 to 5 MPa over a period of 0.5 to 10 hours. A combination with reinforcing materials such as, for example, glass fibers and mineral fibers, is possible. The combination with other binders such as, for example, phenol resins and polyester resins, during the processing of the silicone resin-bonded papers based on sheet silicates and obtained from the suspension of the invention is also possible.

Using the suspension of the invention, silicone resin-bonded papers, which are based on sheet silicate and can be produced as prepregs for moldings having improved mechanical properties, can be produced in an ecologically advantageous manner since solvents are not discharged from the process and, the development of dust during processing is minimized. It is surprising that the combination of polymeric silicone resins with the monomeric and/or oligomeric organosilicon compounds results in a synergistic effect with regard to the mechanical properties of the micanite sheets produced.

Having now generally described the invention, a further understanding can be obtained by reference to certain specific examples which are provided herein for purpose of illustration only and are not intended to be limiting unless otherwise specified.

EXAMPLE 1

A 37.5 g amount of mica scales (muscovite of average diameter 4–5 mm) and 0.25 g of methyltriethoxysilane were stirred in 410 g of water at 25° C. for 30 min. Thereafter, 5 g of a silicone resin which corresponds essentially to the formula $CH_3SiO_{3/2}$ and has a glass transition temperature of 52° C., were added and thoroughly stirred for 15 min with 0.3 g of aluminum octanoate silanized with N-aminoethyl-3-aminopropyltrimethoxysilane. In a discontinuously operating paper sheet former, papers (prepregs) having a thickness of 0.2 mm were produced from the pulp. Micanite sheets were produced by molding the prepregs for two hours at 200° C. and 3 MPa.

EXAMPLE 2

A 42 g amount of mica scales (analogous to Example 1), 0.3 g of silanized aluminum octanoate and 0.35 g of propyltrimethoxysilane and 5 g of a silicone resin, which essentially corresponds to the formula $CH_3SiO_{3/2}$ and has a glass transition temperature of 48° C., were thoroughly stirred for 30 min in 400 g of water. In a discontinuously operating paper sheet former, papers (prepregs) having a thickness of 0.5 mm were produced from the pulp. Micanite sheets were produced by molding the prepregs for two hours at 200° C. and 3 MPa.

EXAMPLE 3

A 42 g of mica scales (analogous to Example 1), 0.5 g of polymeric tetrabutyl titanate and 0.1 g of aminopropyltrimethoxysilane and 0.25 g of octyl triethoxysilane were stirred in 400 g of water at 25° C. for 30 min. Thereafter, 5 g of a silicone resin which essentially corresponds to the formula $CH_3SiO_{3/2}$ and has a glass transition temperature of 52° C., were added and were thoroughly stirred for 15 min together with 0.3 g of aluminum octanoate and 0.4 g of a water-soluble polyether-polysiloxane. In a discontinuous paper sheet former, papers (prepregs) having a thickness of 0.2 mm were produced from the pulp. Micanite sheets were produced by molding the prepregs for two hours at 200° C. and 3 MPa.

EXAMPLE 4

A 40 g amount of mica scales (biotite, particle diameter 1–2 mm) and 0.2 g of glycidyloxypropyltrimethoxysilane, 0.2 g of ethyltrimethoxysilane and 0.3 g of aluminum octanoate were stirred in 410 g of water at 25° C. for 30 min. Thereafter, 5 g of a silicone resin which essentially corresponds to the formula $CH_3SiO_{3/2}$ and has a glass transition temperature of 52° C. were added and were thoroughly mixed for 15 min. In a discontinuous paper sheet former, papers (prepregs) having a thickness of 0.08 mm were produced from the pulp. Micanite sheets were produced by molding the prepregs for two hours at 200° C. and 3 MPa.

EXAMPLE 5

A 40 g amount of mica scales (biotite, particle diameter 1–2 mm) and 3.6 g of a 20% strength acqueous solution of a hydrolysis product of propylmethyldimethoxysilane, aminopropyltriethoxysilane and propyltrimethoxysilane in the ratio 1:1:2 were stirred in 410 g of water for 30 min.

Thereafter, 5 g of a silicon resin, which essentially corresponds to the formula $CH_3SiO_{3/2}$ and has a glass transition temperature of 52° C. and 0.25 g of a catalyst paste (prepared by thorough mixing of 45 g of isopropylmethyltitanate polymer (PMTP), 15 g of N-aminoethyl-3-aminopropyltrimethoxysilane and 40 g of water) were added and were thoroughly stirred for 15 min. In a discontinuous paper sheet former, papers (prepregs) having a thickness of 0.08 mm were produced from the pulp. Micanite sheets were produced by molding the prepregs for two hours at 200° C. and 3 MPa.

EXAMPLE 6 (Comparison)

A 37.5 g amount of mica scales (analogous to Example 1) and 5 g of a silicone resin, which essentially corresponds to the formula $CH_3SiO_{3/2}$ and has a glass transition temperature of 52° C., were added to 410 g of water and thoroughly stirred for 45 min together with 0.3 g of aluminum octanoate. In a discontinuous paper sheet former, papers (prepregs) having a thickness of 0.2 mm were produced from the pulp. Micanite sheets were produced by molding the prepregs for two hours at 200° C. and 3 MPa.

EXAMPLE 7 (Comparison)

A 37.5 g amount of mica scales (analogous to Example 1) and 5 g of glycidyloxypropyltrimethoxysilane were thoroughly stirred in 410 g of water for 45 min. In a discontinuous paper sheet former, papers (prepregs) having a thickness of 0.2 mm were produced from the pulp. Micanite sheets were produced by molding the prepregs for two hours at 200° C. and 3 MPa.

The test results of Examples 1–7 are listed in Table 1.

TABLE 1

Test results of the micanite sheets produced

| Example No. | Water absorption [%] | Tensile strength [MPa] |
|---|---|---|
| 1 | 0.2 | 1.25 |
| 2 | 0.1 | 1.3 |
| 3 | 0.1 | 1.4 |
| 4 | 0.2 | 1.3 |
| 5 | 0.2 | 1.2 |
| 6 (Comparison) | 1.7 | 0.8 |
| 7 (Comparison) | 1.0 | 0.2 |

The improvement in the mechanical properties was assessed from the water absorption after storage for 24 h in demineralized water and from the tensile strength of the micanite sheets produced.

The micanite sheets produced using the papers produced by the present invention have substantially better mechanical properties (substantially lower water absorption and substantially higher tensile strength) than the products produced of the prior art.

The disclosure of German priority application 197 19 302.1 filed May 7, 1997 is hereby incorporated by reference.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent is:

1. A suspension for the solvent-free production of silicone resin-bonded papers based on sheet silicates, which consists of (a) 100 parts by weight of a sheet silicate, (b) 100 to 10,000 parts by weight of water, (c) 0.1 to 5 parts by weight of at least one silane of formula (I):

$$(R'O)_aSiR_{4-a} \quad (I)$$

in which R denotes substituted or unsubstituted hydrocarbon radicals having 1 to 20 carbon atoms and R' denotes $C_{1-10}$-alkyl, aryl, alkylaryl or hydrogen and a assumes a value from 1 to 3, and/or the partial hydrolysis product thereof, (d) 1 to 50 parts by weight of a pulverulent silicone resin of formula (II):

$$(R'O)_bSiR_cO_{(4-b-c)/2} \quad (II)$$

in which R and $R^1$ have the abovementioned meaning and b assumes a value from 0 to 0.5 and c a value from 0.7 to 1.3, with the proviso that at least 5 parts by weight of the silicone resin of formula (II) are used per part by weight of the compound of formula (I), (e) 0.01 to 20 parts by weight of a compound catalyzing the hydrolysis and/or condensation of the compounds of formulae (I) and/or (II) and (f) optionally further known additives.

2. The suspension as claimed in claim 1, wherein the sheet silicate is mica.

3. The suspension as claimed in claim 1, wherein the compound of formula (I) is an alkyltrialkoxysilane and/or the partial hydrolysis products thereof.

4. The suspension as claimed in claim 1, wherein the substituted or unsubstituted hydrocarbon R group is ethyl, hexyl, cyclohexyl, isopropyl, isoamyl radicals, tert-butyl, tert-pentyl, phenyl, naphthyl, anthryl, tolyl, benzyl, vinyl, allyl, norbornyl, trifluoropropyl, cyanoethyl, aminopropyl, alkoxyaryl, alkoxyalkyl or haloaryl.

5. The suspension as claimed in claim 1, wherein R' is methyl, ethyl, propyl or butyl.

6. The suspension as claimed in claim 1, wherein the compound of formula (I) is selected from the group consisting of methyltrimethoxysilane, methyltriethoxysilane, ethyltrimethoxysilane, ethyltriethoxysilane, propyltrimethoxysilane, isobutyltriethoxysilane, octyltrimethoxysilane, octyltriethoxysilane, dimethyldiethoxysilane, dimethyldimethoxysilane, trimethylmethoxysilane, triphenylmethoxysilane, triphenylethoxysilane, N-aminoethyl-3-aminopropyltrimethoxysilane, 3-aminopropyltrimethoxysilane, 3-aminopropyltriethoxysilane, N-aminoethyl-3-aminopropylmethyldimethoxysilane, 3-glycidyloxypropylmethyldiethoxysilane, 3-glycidyloxypropyltrimethoxysilane, methacryloyloxypropyltrimethoxysilane 3-ureidopropyltriethoxysilane, 3-mercaptopropylmethyldimethoxysilane, and cyanopropyltrimethoxysilane.

7. The suspension as claimed in claim 1, wherein R is methyl, ethyl, or phenyl and R' is methyl, ethyl, propyl or butyl.

8. The suspension as claimed in claim 1, wherein the silicone resin of formula (II) ranges from 2000 to 50,000 g/mol.

9. The suspension as claimed in claim 1, wherein the pulverulent silicone resin of formula (II) is an alkylsilicone resin.

10. The suspension as claimed in claim 1, wherein said catalyst compound (e) is an organometallic compound.

11. The suspension as claimed in claim 10, wherein said organometallic compound has the formula:

$$R^1_gMR^2_{(w-g)-(z*h)}L_h \quad \text{(III)}$$

wherein $R^1$ represents identical or different, substituted and/or unsubstituted carboxyl radicals having 1 to 30 carbon atoms and/or identical or different, substituted and/or unsubstituted alkoxy radicals having 1 to 4 carbon atoms and $R^2$ represents identical or different, substituted and/or unsubstituted hydrocarbon radicals having 1 to 10 carbon atoms, M is a metal of the 2nd, 3rd or 4th main group or 2nd to 8th subgroup of the Periodic Table, L represents identical or different chelate ligands having z bonds to the metal M, w is the coordination number of M, g assumes a value of from 1 to w and h assumes values ranging from 0 to 3, and/or the partial hydrolysis products thereof.

12. The suspension as claimed in claim 11, wherein said organometallic compound having formula (III) is silanized, in the presence of water, with an organosilicon compound of the formula:

$$R^3_aSiX_{(4-a)} \quad \text{(IV)}$$

wherein $R^3$ represents identical or different, substituted and/or unsubstituted hydrocarbon radicals having 1 to 10 carbon atoms, with the proviso that at least one radical $R^3$ per compound (III) contains a polar group, X is at least one hydrolyzable radical selected from the group consisting of alkoxy, alkenyloxy, acetoxy, amino, amido, aminoxy, oximino and halogen groups and a is an integer ranging from 1 to 3, and/or the partial hydrolysis products thereof.

13. The suspension as claimed in claim 1, wherein said composition further comprises a surface-active compound.

14. A process of preparing the suspension as claimed in claim 1, which comprises:

mixing the sheet silicate, water and organosilicon compound of formula (I) for at least one minute; and then mixing the silicone resin with the mixed materials.

15. The process as claimed in claim 14, wherein the catalyst is mixed together with sheet silicate, water and compound of formula (I).

* * * * *